US006253407B1

(12) United States Patent
Bjelkevig

(10) Patent No.: US 6,253,407 B1
(45) Date of Patent: Jul. 3, 2001

(54) FOOT SCRUBBER

(76) Inventor: Randy Bjelkevig, 931 Avenue D, Billings, MT (US) 59102

( * ) Notice: Subject to any disclaimer, the term of this patent is extended or adjusted under 35 U.S.C. 154(b) by 0 days.

(21) Appl. No.: 09/234,361

(22) Filed: Jan. 20, 1999

(51) Int. Cl.[7] ..... A46B 9/02; A47L 23/26

(52) U.S. Cl. ..... 15/160; 15/161; 15/215; 15/217; 4/606; 601/136

(58) Field of Search ..... 15/107, 116, 114, 15/146, 159.1, 160, 161, 186, 201, 202, 210.1, 215, 217, 227, 238, 104.92; 601/136; 4/606

(56) References Cited

U.S. PATENT DOCUMENTS

| | | | | |
|---|---|---|---|---|
| 2,591,331 | * | 4/1952 | Baumbach | 15/160 |
| 2,852,793 | * | 9/1958 | Shelton | 15/161 |
| 3,604,043 | * | 9/1971 | Lewis, Jr. | 15/186 |
| 3,612,044 | * | 10/1971 | Gurrola | 4/606 |
| 3,804,699 | * | 4/1974 | Johnson | 15/217 |
| 4,415,618 | * | 11/1983 | McClung, Jr. | 428/88 |
| 4,520,525 | * | 6/1985 | Yogi et al. | 4/606 |
| 4,532,668 | * | 8/1985 | Slonicki | 15/161 |
| 4,704,759 | * | 11/1987 | Mesa | 4/606 |
| 4,866,805 | * | 9/1989 | Oden et al. | 15/104.92 |
| 5,177,829 | * | 1/1993 | Simpson | 15/104.92 |
| 5,293,660 | * | 3/1994 | Park | 15/160 |
| 5,321,867 | * | 6/1994 | Probst | 15/160 |
| 5,445,438 | * | 8/1995 | Drumm | 15/186 |
| 5,685,042 | * | 11/1997 | Demetriades | 15/230 |
| 5,724,695 | * | 3/1998 | Galizia | 15/160 |
| 5,758,381 | * | 6/1998 | Rocha | 15/160 |
| 5,779,653 | * | 7/1998 | Thompson | 601/136 |

FOREIGN PATENT DOCUMENTS

| | | | | |
|---|---|---|---|---|
| 173541 | * | 6/1952 | (DE) | 15/161 |
| 2123281 | * | 2/1984 | (GB) | 15/160 |

* cited by examiner

*Primary Examiner*—Gary K. Graham
(74) *Attorney, Agent, or Firm*—Albert O. Cota

(57) ABSTRACT

A foot scrubber (10) designed to be placed on a shower floor to allow a person who experiences difficulty to cleanse their feet. The foot scrubber (10) consists of a base (12) having an upper surface (14), a lower surface (16) and side edges (18). From the upper surface (14) extends upward a multiplicity of bristles (24). The foot scrubber (10) can be also designed to include an upward extending section (40) that is attached to each of the side edges (18). The sections (40) include an inner surface (44) having a multiplicity of inward extending bristles (24) that allow the sides of the feet to easily cleaned. To use the foot scrubber (10), a person applies soap to the bristles (24) and then rubs his/her foot on the bristles (24).

13 Claims, 2 Drawing Sheets

FOOT SCRUBBER

TECHNICAL FIELD

The invention pertains to personal hygiene devices and, more particularly, to a device which assists an individual in cleaning his/her feet while standing in a shower.

BACKGROUND ART

For many people, some of the most commonly performed actions can pose serious and dangerous problems. This is especially true when it comes to bathing. Older people and those with physical disabilities have a much more difficult time merely entering a bathing area, not to mention actually cleaning themselves. One of most dangerous actions is that of a person bending or stooping over, or raising his/her leg and foot in order to clean the feet. People who suffer from one or more of the many afflictions that affect older individuals, or those persons with physical disabilities, can suffer major injuries resulting from falling in a shower. People who are overweight also have tremendous difficulty, in that it is all but impossible for them to bend over. Due to the slippery surface of a wet shower floor, the danger of losing balance and falling is just as great for an overweight person as it is for an older person or a disabled person.

For as long as people have been bathing in a standing position there have been attempts to remedy the problem of safely cleansing the feet. Of course, one of the most effective means of guaranteeing a safe bathing experience is to have assistance from another person. Although the risk of injury with assistance is practically nil, the majority of people would rather risk the injury then suffer the humiliation of this type of help.

There have also been devices and methods that have attempted to solve this problem. One such device consists of soap that is attached to one end of a stick. The idea was that a person could apply the soap while holding the stick. This idea, although sounding good in theory, was actually more dangerous in that people were losing their balance trying to manipulate the stick. Other methods have suggested dropping a piece of soap on the floor of the shower and then rubbing the foot over soap. This method only made the already slippery floor even more slippery. Another method suggested that people grip the sides of the shower and slowly lower themselves to a sitting position. If the person did not fall trying to lower themselves, they found it almost impossible to reach both their feet and to get back up to a standing position. Obviously, their is a need for a device that will allow a person to easily and safely clean their feet while taking a shower. Safety should be the primary concern and therefore the device should not present any new, or increase already present dangers resulting from this type of cleaning movement.

A search of the prior art did not disclose any patents that read directly on the claims of the instant invention, however the following U.S. patents are considered related:

The U.S. Pat. No. 5,575,034 discloses a foot cleaning and massaging shower mat that is comprised of an upper planar surface and a parallel lower planar surface. The upper and lower surfaces are both formed in a rectangular configuration and are coupled around their periphery. An aperture is formed in the center of the mat and an upwardly extending recess is formed from the lower surface of the mat around the aperture. An insert is positioned within the recess which has a plurality of apertures in a symmetric configuration. A plurality of upstanding bristle-like members extend upwardly from the upper surface of the mat between the aperture and the periphery.

The U.S. Pat. No. 5,293,660 discloses a foot scrub mat which includes a flexible base and a replaceable pad which are preferably made of an non-slip material. The base has an interior cut-out area of selected dimensions. The replaceable pad has a bristled area which has the general dimensions of the cut-out area and which is exposed when the pad is aligned beneath the cut-out area. The replaceable pad has an exterior rim which lies under the base when the pad is placed beneath and aligned with the cut-out area.

The U.S. Pat. No. 5,215,348 discloses a foot pad structure on a rug in an automobile which includes a detachable pedal piece. The pedal piece has a front side that is to be pedaled by a driver, while the back side thereof is fixedly attached to a base plate. The pedal piece can directly be fastened together as one piece with the base plate of the foot pad in an automobile.

The U.S. Pat. No. 4,532,668 discloses a foot scrubber comprising a housing, brushes attached to the inner surfaces of the housing and at least one suction cup for attaching the housing to a surface. The scrubber also includes a compressible dispenser for dispensing liquid soap when pressure is applied, an arm for applying pressure on the compressible means, and a handle rigidly connected to the arm by a substantially vertical shaft. The arm can be vertically displaced in a downward direction, thereby compressing the compressible dispenser.

DISCLOSURE OF THE INVENTION

The foot scrubber disclosed herein is designed to be placed upon a shower floor and to be used primarily by persons having difficulty in bending or stooping over to cleanse their feet. Once the foot scrubber is securely placed on the shower floor, a bather can remain standing and the feet can be easily cleansed by rubbing the feet over a multiplicity of bristles extending from the surface of the foot scrubber.

In its most basic form, the foot scrubber consists of a base that includes an upper surface and a lower surface. To the upper surface is formed or attached the multiplicity of upward extending resilient bristles. To the lower surface is attached a means to prevent the device from slipping from the shower floor. The attachment means can consist of a non-slip surface or a plurality of suction cups.

The foot scrubber can be designed and dimensioned to accommodate either foot, the right foot or the left foot. Additionally, the upper surface can be contoured to substantially follow the contour of a person's foot. The bristles, which are preferably formed when the base is molded, have a longer length at the section of the contoured surface that encompasses the arch and the toes of the foot. By having staggered bristles lengths, the entire bottom surface of a person's foot receives an equal scrubbing force.

To add further utility to the foot scrubber, a toe scrubber can be added to the base and an upward extending section can be added to the right and left central edges of the base. The inner side of each upward extending section includes a multiplicity of bristles. Thus, the combination of the toe scrubber, the side bristles and the base bristles allows a foot to be thoroughly cleaned.

The foot scrubber can also be designed to include a detachable resilient section that has an upper surface and a lower surface. The upper surface includes a multiplicity of bristles and the lower surface includes an attachment means that allows the resilient section to be easily and periodically removed from the base for cleaning.

In view of the above disclosure, it is the primary object of the invention to provide a foot scrubber that attaches to a shower floor and that is primarily intended for use by persons having difficulty bending or stooping over to cleanse their feet.

In addition to the primary object of the invention it is also an object of the invention to provide a foot scrubber that:

- can be used by able bodied persons as well as physically challenged persons,
- can be attached to a shower floor or to an end of a bath tub,
- can be made with various bristle stiffness,
- can be molded of various materials or constructed of various sections,
- is relatively maintenance free,
- is cost effective from both manufacturing and consumer points of view, and
- can be made in sized ranging from small to extra large.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
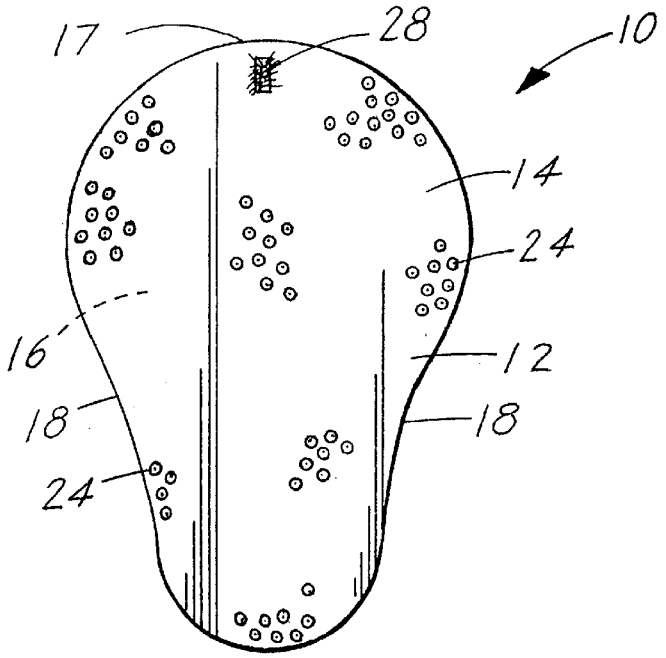
FIG. 1 is a top plan view of a foot scrubber having a multiplicity of upward extending bristles and having a shape that accommodates either a right or left foot.

The best mode for carrying out the invention is presented in terms of a preferred embodiment for a foot scrubber which is designed to assist an individual in cleaning his/her feet. The foot scrubber is especially directed toward people who experience mild to severe difficulty in performing the physical movements necessary to clean their feet. Some people who experience difficulty are those with physical disabilities and those who are overweight. For anyone who does not have a disability or weight problem, the cleansing of their feet is not a serious problem but does present some degree of difficulty and danger. For those with a disability or weight problem, cleaning their feet is often impossible and definitely difficult and dangerous.

When a person is standing in a shower, the movements necessary to cleanse their feet included bending over or lifting the leg and foot. These movements in certain situations can cause the person to slip and fall, often suffering major injuries. The foot scrubber alleviates the need for a person to either bend over or lift their leg and foot. Although the foot scrubber is a great benefit for those people having difficulty cleaning their feet, the foot scrubber also allows other people to clean their feet in a safer, more comfortable manner.

The foot scrubber is simple to use, as it only requires a person to apply soap to the scrubber, place the scrubber on a shower floor, and then rub their feet upon the soapy surface of the scrubber. Again, although the foot scrubber may seem like a simple idea, the benefits it provides are tremendous to those who have difficulty cleaning their feet, as well as those who have no difficulty but would appreciate a safer and easier method to cleanse their feet.

The foot scrubber 10, as shown in FIGS. 1–7, is comprised of the following major elements: a base 12, bristles 24, a resilient section 30, an upward extending section 40, a non-slip material 50 and suction cups 58.

Figure 2:
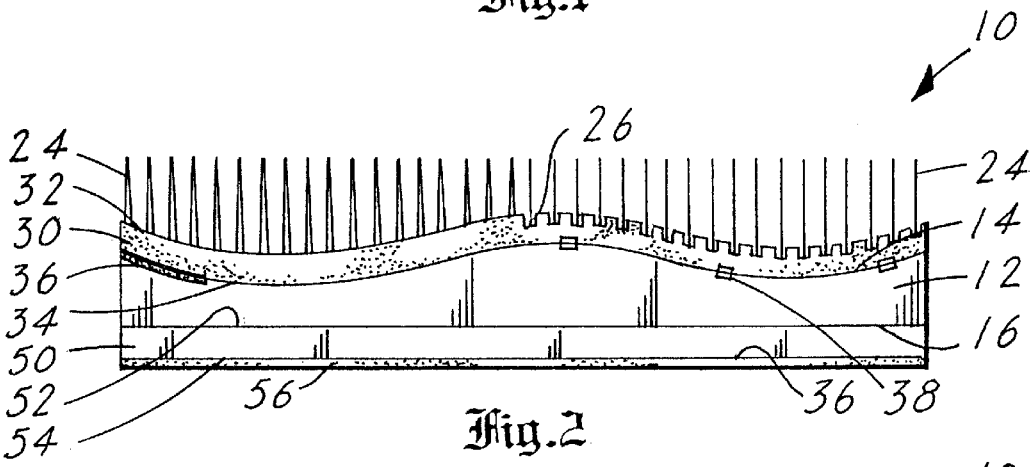
FIG. 2 is a side elevational view showing a resilient section attached to the upper surface of the base, a multiplicity of molded bristles on the left side of the figure, a multiplicity of bristles cavities and bristles on the right side of the figure, and a lower surface covered with a non-slip material.
Figure 3:
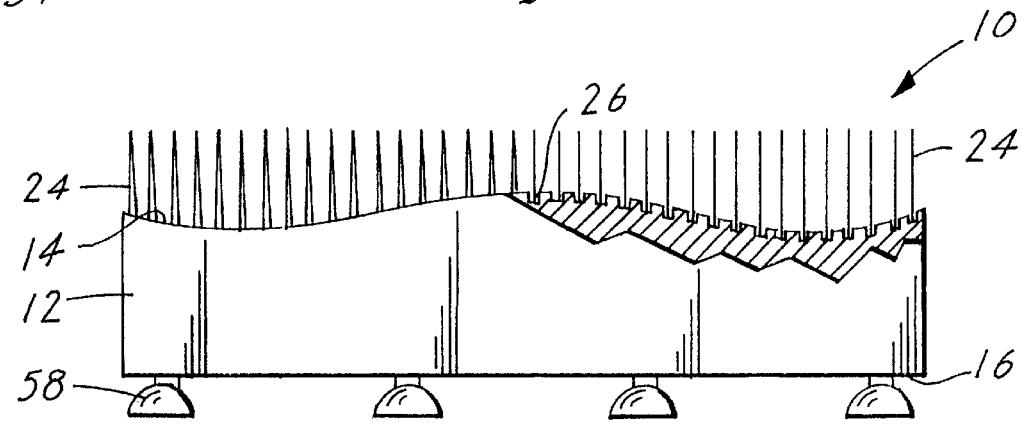
FIG. 3 is a side elevational view showing a multiplicity of molded bristles on the left side of the figure, a multiplicity of bristle cavities and bristles on the right side of the figure, and a lower surface having attached a plurality of suction cups.
Figure 4:
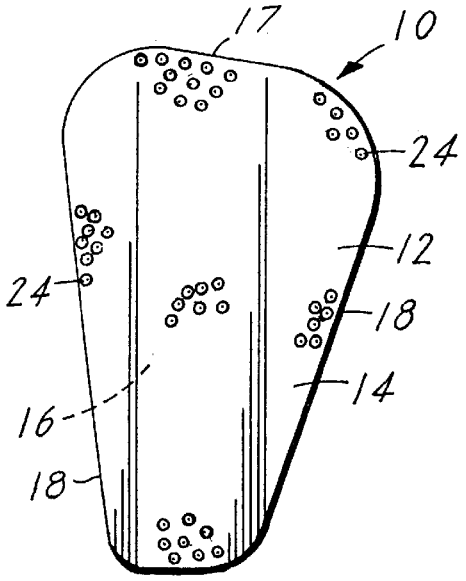
FIG. 4 is a top plan view of a foot scrubber dimensioned to accommodate a right foot.
Figure 5:
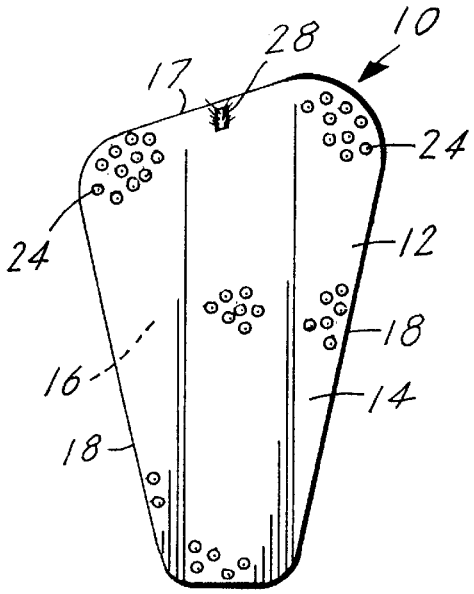
FIG. 5 is a top plan view of a foot scrubber dimensioned to accommodate a left foot.

The base 12, as shown in FIGS. 1–3, has an upper surface 14, a lower surface 16, a front edge 17 and side edges 18. The base 12, as shown in FIGS. 2 and 3, is contoured to substantially conform to the contour of a person's foot. The base 12 is also dimensioned to accommodate either a right or left foot, as shown in FIG. 1, a right foot, as shown in FIG. 4, or a left foot as shown in FIG. 5. The base preferably constructed of a resilient material such as rubber, however, a rigid material such as a plastic or a wood may also be used.

The base 12 incorporates a multiplicity of bristles 24 that extend upward from the upper surfaces 14 of the base 12. In a preferred design, the bristles 24 are formed at the same time the base 12 is molded, as shown on the left side of FIG. 3. Alternatively, as shown on the right side of the FIG. 3, the base 12 can include a multiplicity of bristle cavities 26 which are typically formed by a multiple drilling tool. Into the cavities are inserted and attached by an adhesive, a like multiplicity of bristles. The inserted bristles can be made of a natural fiber or a synthetic material, such as plastic.

The bristles 24, as shown in FIGS 1–3, 6 and 7, function in the same manner as a scrubbing member on a typical brush. To use the foot scrubber 10 a person applies soap to the bristles and then rubs his/her foot on the bristles 24. The movement of the foot, in combination with the soap causes the bristles 24 to scrub dirt off of the foot, remove dried skin and improve circulation.

The upper surface 14 of the base 12 is preferably contoured to substantially follow the contour of a person's foot as shown in FIGS. 2 and 3. To further improve the efficiency of the foot scrubber 10, the bristles 24 that are attached to the section of the base 12 which encompasses the arch and the toes of a foot have a longer length than the surrounding bristles. This insures that the entire bottom surface of a person's foot will receive equal scrubbing.

Figure 8:
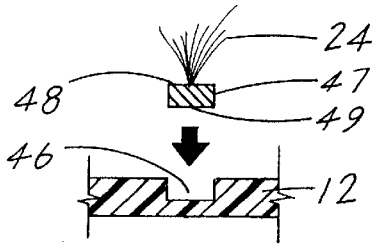
FIG. 8 is a partial sectional view showing a base with a cavity into which is inserted a toe scrubber.

Additionally, a toe scrubber 28, as shown in FIGS. 1, 5 and 8, can be attached, by an attachment means, to the upper surface 14 and near the front edge 17 of the base 12 as shown in FIGS. 1 and 5. The toe scrubber 28 is attached to the base by means of a block cavity 46 and a block 47. The cavity 46 is located on the upper surface 14 and near the front edge 17 of the base 12. The block 47, which has an upper surface 48 and a lower surface 49, is dimensioned to be removably inserted into the block cavity 46 as shown in FIG. 8. From the upper surface 48 of the block 47 extends upward a multiplicity of bristles 24 grouped to fit between the toes of a foot.

As shown in FIG. 2, the foot scrubber 10 may be further comprised of the relatively thin resilient section 30. The resilient section 30 is dimensioned to follow the shape and contour of the base 12, and includes an upper surface 32 and a lower surface 34. From the upper surface 32 extends a multiplicity of formed bristles 24, as shown on the left side of FIG. 2 or as shown on the right side of FIG. 2. The upper surface 32 can also be made to include a multiplicity of bristle cavities 26 into which are inserted and attached, by an adhesive, a like multiplicity of bristles 24. In order to facilitate greater ease of use and to assist in cleaning the foot scrubber 10, the lower surface 34 of the resilient section 30 is removably attached, by an attachment means, to the upper surface 14 of the base 12. The attachment means as shown in FIG. 2, can consist of an adhesive 36 or a combination male and female detents 38. When the lower surface 34 is detached, both the resilient section 30 and the base 12 can be individually washed.

Figure 6:
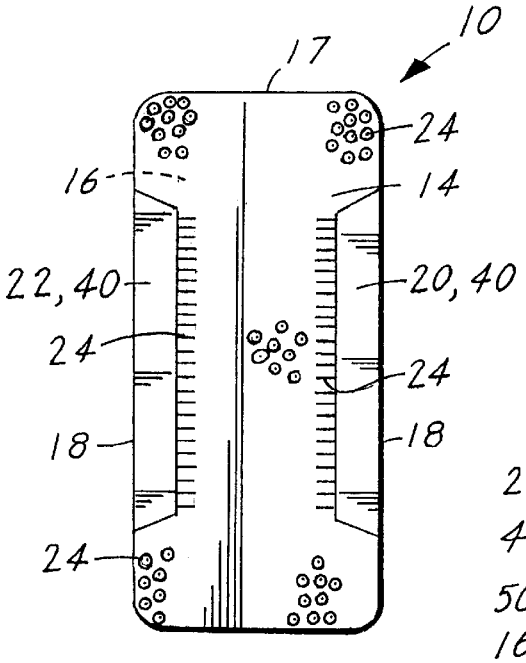
FIG. 6 is a top plan view of a foot scrubber that includes an upward extending bristle section that is located on each side of the base.
Figure 7:
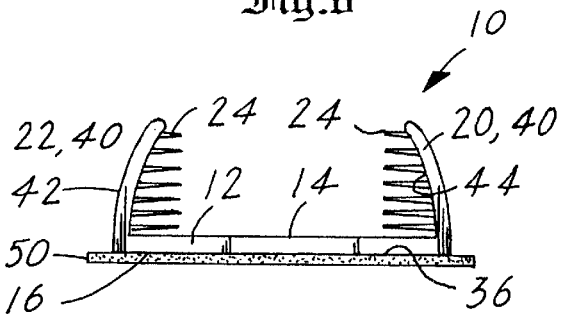
FIG. 7 is a front elevational view of the foot scrubber shown in FIG. 6.

To increase the cleansing power of the foot scrubber 10 it may be designed to include an upward extending section 40, as shown in FIGS. 6 and 7. An upward extending section 40 is attached to the side edges 18 namely the right central edge 20 and the left central edge 22 of the base 12, and is preferably integrally molded with the base 12. The sections 40 have an outer surface 42 and an inner surface 44, with the inner surface 44 having a multiplicity of inward extending bristles 24 that further cleanse the sides of the feet.

To further increase the utility of the foot scrubber 10, a non-slip material 50, as shown in FIG. 2, is utilized. The material 50 includes an upper surface 52 and a lower surface 54. The lower surface 54 is covered with a paint 56 that includes silica sand or an emery grit. The upper surface 52 is attached by an attachment means to the lower surface 16 of the base 12. The non-slip material 50 insures that the foot scrubber 10 remains in a secured position when placed on the shower floor.

In lieu of the non-slip material 50, the foot scrubber 10 may utilize a plurality of suction cups 58, as shown in FIG. 3. The cups 58 have an upper surface 52 that attaches to the lower surface 16 of the base 12 by an attachment means. The suction cups, when pressed against the shower floor, secure the foot scrubber 10 to the shower floor.

While the invention has been described in complete detail and the pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

What is claimed is:

1. A foot scrubber comprising:

a) a base having an upper surface, a lower surface and side edges, b) said upper surface of said base is contoured to substantially follow the contour of a person's foot, c) a relatively thin resilient section dimensioned to conform to the shape and contour of said base and having an upper surface and a lower surface, wherein from the upper surface extends a multiplicity of molded bristles integral with the resilient section and wherein the lower surface is removably attached, by an attachment means, to the upper surface of said base, and d) an upward extending section located in each side edge of said base, wherein said upward extending section has an outer surface and an inner surface with the inner surface having a multiplicity of inward extending bristles.

2. The foot scrubber as specified in claim 1 wherein said base and bristles are molded of a synthetic plastic material.

3. The foot scrubber as specified in claim 1 wherein said base is dimensioned to accommodate either a right foot or a left foot.

4. The foot scrubber as specified in claim 1 wherein said base is dimensioned to accommodate a right foot.

5. The foot scrubber as specified in claim 1 wherein said base is dimensioned to accommodate a left foot.

6. The foot scrubber as specified in claim 1 wherein said base is constructed of a resilient material.

7. The foot scrubber as specified in claim 1 further comprising a non-slip material having an upper surface and a lower surface, wherein the upper surface is attached, by an attachment means, to the lower surface of said base.

8. The foot scrubber as specified in claim 1 further comprising a plurality of suction cups having an upper surface that is attached to the lower surface of said base.

9. The foot scrubber as specified in claim 1 further comprising a toe scrubber attached, by an attachment means, to the upper surface and near a front edge of said base, wherein said toe scrubber consists of a block having an upper surface wherefrom extends upward a multiplicity of toe scrubber bristles.

10. The foot scrubber as specified in claim 9 wherein said means for attaching said foot scrubber to said base comprises a block cavity located on the upper surface and near the front edge of said base where into said block cavity is removably inserted said block.

11. A foot scrubber comprising:

a) a base having an upper surface, a lower surface and side edges, b) said upper surface of said base is contoured to substantially follow the contour of a person's foot, and c) a relatively thin resilient section dimensioned to conform to the shape and contour of said base and having an upper surface and a lower surface, wherein from the upper surface extends a multiplicity of bristle cavities into which are inserted and attached a multiplicity of bristles and wherein the lower surface is removably attached, by an attachment means, to the upper surface of said base.

d) an upward extending section located in each side edge of said base, wherein said upward extending section has an outer surface and an inner surface with the inner surface having a multiplicity of inward extending bristles, wherein said upwardly extending section is integrally molded with said base.

12. The foot scrubber as specified in claim 11 wherein said bristles are made of a natural fiber.

13. The foot scrubber as specified in claim 11 wherein said bristles are made of a synthetic material.

* * * * *